US009872527B2

(12) United States Patent
Boillat-Macon

(10) Patent No.: US 9,872,527 B2
(45) Date of Patent: Jan. 23, 2018

(54) CROTCHLESS PANTS WITH REMOVABLE COVERS

(71) Applicant: Madeline Carol Boillat-Macon, Deridder, LA (US)

(72) Inventor: Madeline Carol Boillat-Macon, Deridder, LA (US)

( * ) Notice: Subject to any disclaimer, the term of this patent is extended or adjusted under 35 U.S.C. 154(b) by 88 days.

(21) Appl. No.: 14/881,744

(22) Filed: Oct. 13, 2015

(65) Prior Publication Data

US 2017/0099887 A1 Apr. 13, 2017

(51) Int. Cl.

| | |
|---|---|
| ***A41D 13/12*** | (2006.01) |
| ***A41B 9/00*** | (2006.01) |
| *A41D 1/06* | (2006.01) |

(52) U.S. Cl.

CPC ..... *A41D 13/1254* (2013.01); *A41D 1/065* (2013.01)

(58) Field of Classification Search

CPC .. A41B 9/04; A41B 9/026; A41B 9/02; A41B 9/007

See application file for complete search history.

(56) References Cited

U.S. PATENT DOCUMENTS

| | | | | |
|---|---|---|---|---|
| 676,336 | A * | 6/1901 | McGuire | A41B 9/04 2/408 |
| 2,010,483 | A * | 8/1935 | Goodman | A41B 9/12 2/78.2 |
| 2,396,599 | A * | 3/1946 | O'Brien | A41B 9/04 2/408 |
| 4,930,161 | A | 6/1990 | Cohen | |
| 5,257,956 | A | 11/1993 | Ewen | |
| 5,341,515 | A | 8/1994 | Cohen | |
| 5,636,387 | A * | 6/1997 | Lundy | A61F 5/0096 2/400 |
| 5,930,838 | A | 8/1999 | Carter-Scott-Pomije | |
| 6,936,021 | B1 | 8/2005 | Smith | |
| 8,087,098 | B2 * | 1/2012 | Kimberly | A41B 9/001 2/227 |

* cited by examiner

*Primary Examiner* — Anna Kinsaul

(74) *Attorney, Agent, or Firm* — Dunlap Bennett & Ludwig PLLC

(57) ABSTRACT

A lower garment with a crotch opening is provided. A front cover is releasably attached to the front side of the lower garment and is sized to cover a front portion of the crotch opening. A rear cover is releasably attached to the rear side of the lower garment and is sized to cover a rear portion of the crotch opening. The front cover and the rear cover are removable from the lower garment independent of each other. Therefore, only a portion of the patient's body that needs to be exposed is exposed, while other portions are covered.

10 Claims, 3 Drawing Sheets

CROTCHLESS PANTS WITH REMOVABLE COVERS

BACKGROUND OF THE INVENTION

The present invention relates to medical pants for patients and, more particularly, to crotchless pants with removable covers.

In proctological, urological and gynecological examinations and treatments a doctor's and medical assistant's need for access to a patient's perineum region presents problems for both the patient and the doctor. Typically, the patient disrobes and dons an examination gown. Such a gown provides the doctor with easy access to the patient's perineum region. Though this does reduce the patient's area of exposure, such still exposes more of the patient's body than necessary. Thus, the patient is subjected to undue embarrassment and exposure to the coolness of medical offices and hospitals just at a time when it is important that the patient be relaxed and as comfortable as possible. The anxiety which may result from the patient being uncomfortable may result in complicating the doctor's diagnosis and treatment.

As can be seen, there is a need for a crotchless medical pants with removable covers.

SUMMARY OF THE INVENTION

In one aspect of the present invention, an apparel comprises: a lower garment designed to cover legs of a patient and comprising a front side, a rear side, and a crotch opening running from the front side to the rear side; a front cover releasably attached to the front side of the lower garment and sized to cover a front portion of the crotch opening; and a rear cover releasably attached to the rear side of the lower garment and sized to cover a rear portion of the crotch opening, wherein the front cover and the rear cover are removable from the lower garment independent of each other.

These and other features, aspects and advantages of the present invention will become better understood with reference to the following drawings, description and claims.

DETAILED DESCRIPTION OF THE INVENTION

Figure 1:
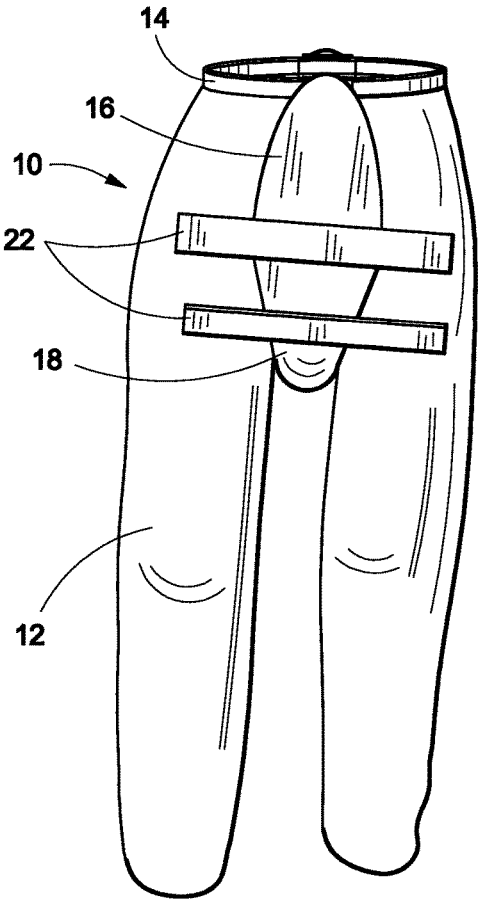
FIG. 1 is a front view of an embodiment of the crotchless pants of the present invention with the crotch straps in place.
Figure 2:
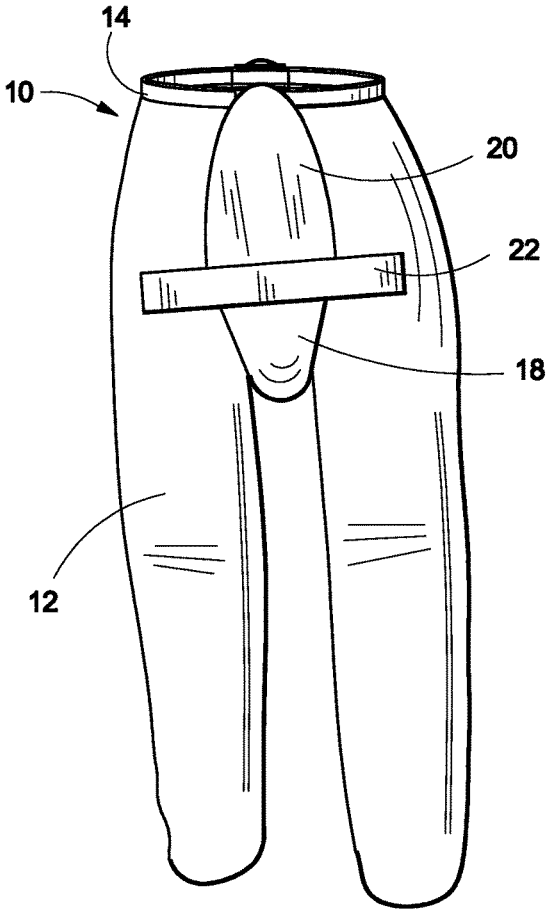
FIG. 2 is a rear view of an embodiment of the crotchless pants of the present invention with the crotch straps in place
Figure 5:
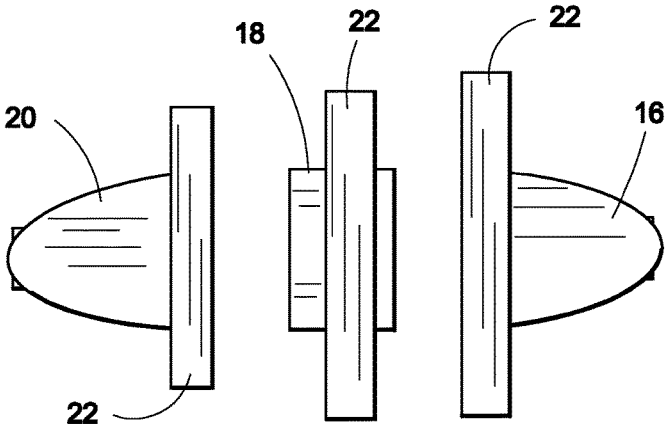
FIG. 5 is an exterior view of the crotch straps laid out flat.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring to FIGS. 1 through 8, the present invention includes an apparel 10. The apparel 10 includes lower garment 12 having a front side and a rear side with a first leg sleeve and a second leg sleeve. The lower garment 12 may be shorts or pants. A crotch opening is formed in between the first leg sleeve and the second leg sleeve and runs from the front side to the rear side.

The present invention may include a front cover 16 and a rear cover 20. The front cover 16 and the rear cover 20 are separate from the lower garment 12. The front cover 16 is releasably attached to the front side of the lower garment and is sized to cover a front portion of the crotch opening. The rear cover 20 is releasably attached to the rear side of the lower garment and is sized to cover a rear portion of the crotch opening. The front cover 16 and the rear cover 20 are removable from the lower garment independent of each other. Therefore, only a portion of the patient's body that needs to be exposed is exposed, while other portions are covered.

In certain embodiments, the present invention may include a middle cover 18. The middle cover 18 is a separate from the front cover 16, the rear cover 20 and the lower garment 12. The middle cover 18 is releasably attached to the lower garment 12 in between the front cover 16 and the rear cover 20. In such embodiments, the front cover 16 may cover a penis or vagina of the patient, the middle cover 18 may cover a perineum of the patient, and the rear cover 20 may cover the anus of the patient. The doctor may remove one of the front cover 16, the middle cover 18, and the rear cover 20 to perform medical examinations or operations on one of the three areas of the patient. The remaining covers 16, 18, 20 remain in place, providing privacy and comfort for the patient.

The front cover 16, the middle cover 18, and the rear cover 20 may each include an inner surface and an outer surface. In certain embodiments, a strap 22 may be secured to the outer surface of each of the front cover 16, the middle cover 18 and the rear cover 20. The straps 22 may each have ends extending beyond a periphery of the covers 16, 18, 20. A mating connector 24 may be attached to each of the ends of the straps 22. Mating connectors 24 may also be attached to the lower garment 12 near an edge of the crotch opening. The ends of the straps 22 may thereby connect to the lower garment 12 such that the covers 16, 18, 20 are attached to the lower garment 12 and disposed to cover crotch opening.

The connectors 24 may include hook and loop fasteners, snap buttons, clips, ties and the like. In certain embodiments, the connectors 24 may be hook and loop fasteners. For example, hook patches may be attached to the straps 22 and loop patches may be attached to the lower garment 12 or alternatively, loop patches may be attached to the straps 22 and hook patches may be attached to the lower garment 12.

Figure 3:
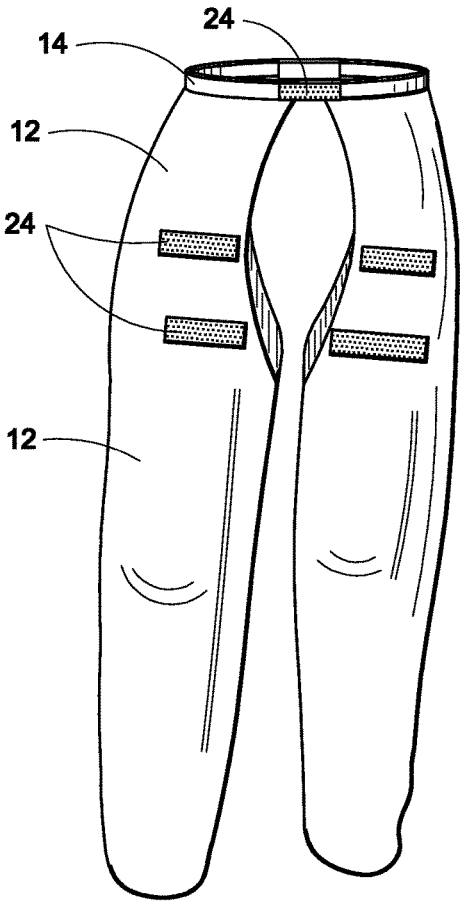
FIG. 3 is a front view of the an embodiment of the crotchless pants of the present invention
Figure 4:
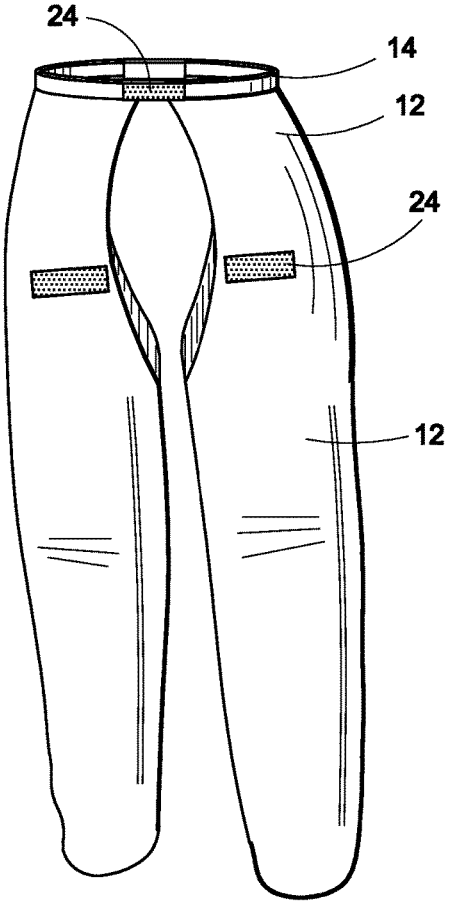
FIG. 4 is a rear view of an embodiment of the crotchless pants of the present invention.
Figure 6:
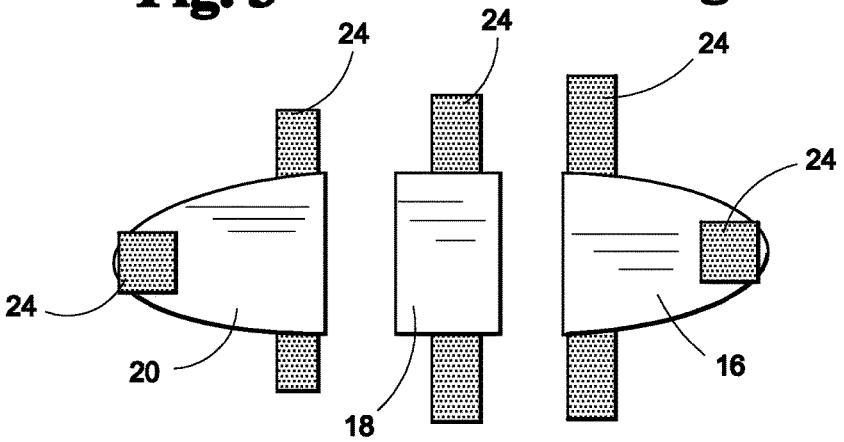
FIG. 6 is an interior view of the crotch straps laid out flat.
Figure 7:
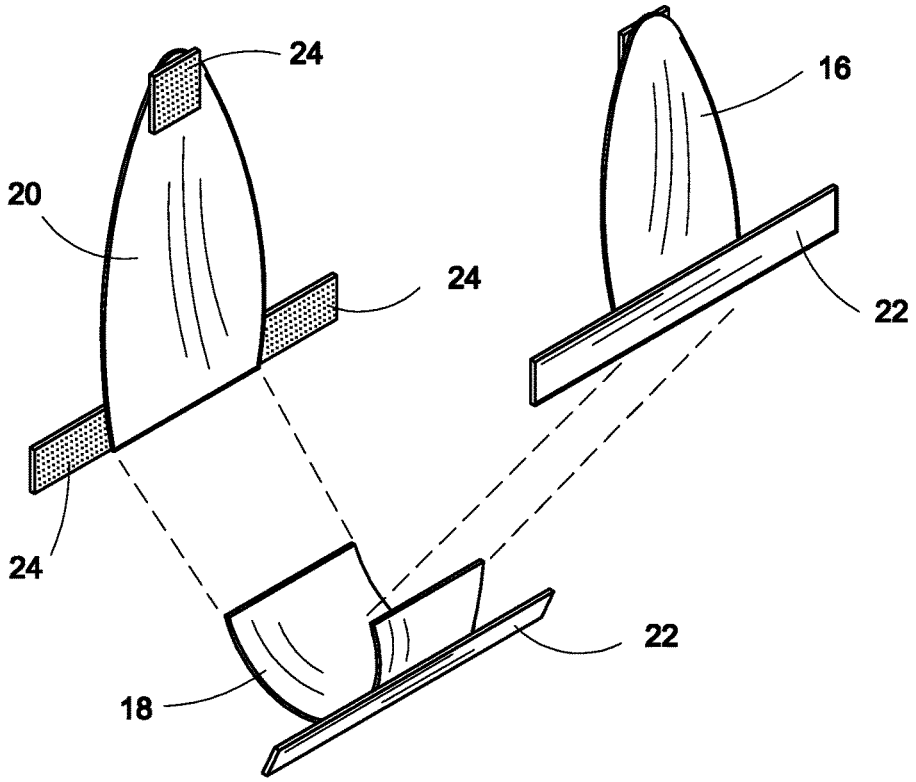
FIG. 7 is an exploded perspective view of the crotch straps prior to fastening to pants.
Figure 8:
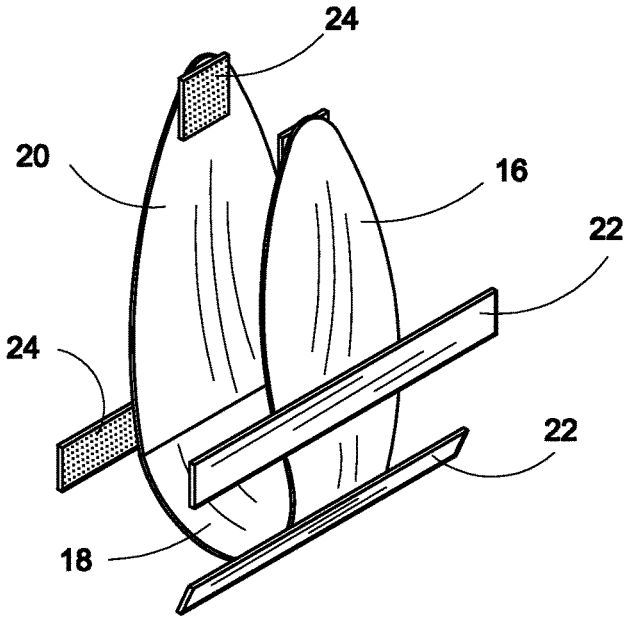
FIG. 8 is an assembled perspective view of crotch straps prior to fastening to pants.

The lower garment 12 of the present invention may include a waistband 14 extending circumferentially about a top end of the lower garment. As best seen in FIGS. 3 and 4, the waistband forms an endless loop. The crotch opening may run front a front side of the waistband 14 to a rear side of the waistband 14. In certain embodiments, an inner end of each of the front cover 16 and the rear cover 20 may include a connector 24 such as the hook and loop patches. In such embodiments, the waist band 14 of the lower garment 12 may include a hook and loop patch on an outer front side and an outer rear side. The end hook and loop patch of the front cover 16 is releasably attachable to the hook and loop patch on the outer front side of the waistband 14 and the end hook and loop patch of the rear cover 20 is releasably attachable to the hook and loop patch on the outer rear side of the waistband 14. The additional connectors 24 aid in securing the front cover 16 and the rear cover 20 to the lower garment 12.

It should be understood, of course, that the foregoing relates to exemplary embodiments of the invention and that modifications may be made without departing from the spirit and scope of the invention as set forth in the following claims.

What is claimed is:

1. An apparel comprising:

a lower garment designed to cover legs of a patient and comprising a front side, a rear side, an endless loop forming a waist band, wherein the waist band comprises a front portion comprising a hook and loop patch and a rear portion opposite the front portion comprising a hook and loop patch, and a crotch opening running from the front portion of the waist band to the rear portion of the waist band;

a front cover comprising a hook and loop patch releasably attached to the hook and loop patch of the front portion of the waist band;

a rear cover comprising a hook and loop patch releasably attached to the hook and loop patch of the rear portion of the waist band;

a first strap connected to the front cover and comprising a first end and a second end each extending beyond a periphery of the front cover; and a second strap connected to the rear cover and comprising a first end and a second end each extending beyond a periphery of the rear cover, wherein the first end and the second end of each of the first strap and the second strap comprise a hook and loop patch releasably attached to a hook and loop patch of the lower garment, wherein the front cover and the rear cover are removable from the lower garment independent of each other.

2. The apparel of claim 1, wherein the lower garment is a pair of pants or a pair of shorts.

3. The apparel of claim 1, wherein the connectors are hook and loop fasteners.

4. The apparel of claim 1, wherein the lower garment further comprises a waist band, wherein the crotch opening runs from a front portion of the waist band to a rear portion of the waist band.

5. The apparel of claim 4, wherein the front portion of the waistband comprises a connector releasably attached to a connector attached to an end of the front cover and the rear portion of the waistband comprises a connector releasably attached to a connector attached to an end of rear cover.

6. The apparel of claim 5, wherein the connectors are hook and loop fasteners.

7. The apparel of claim 1, further comprising a middle cover releasably attached to the lower garment in between the front cover and the rear cover.

8. The apparel of claim 7, further comprising a strap connected to the middle cover and comprising a first end and a second end each extending beyond a periphery of the middle cover, wherein the first end and the second end each comprise a connector releasably attached to the lower garment.

9. An apparel comprising:

a lower garment designed to cover legs of a patient and comprising a front side, a rear side, a waist band comprising a front portion comprising a hook and loop patch and a rear portion comprising a hook and loop patch, and a crotch opening running from the front portion of the waist band to the rear portion of the waist band;

a front cover comprising a hook and loop patch releasably attached to the hook and loop patch of the front portion of the waist band;

a rear cover comprising a hook and loop patch releasably attached to the hook and loop patch of the rear portion of the waist band;

a middle cover releasably attached to the lower garment in between the front cover and the rear cover;

a first strap connected to the front cover and comprising a first end and a second end each extending beyond a periphery of the front cover;

a second strap connected to the rear cover and comprising a first end and a second end each extending beyond a periphery of the rear cover; and a third strap connected to the middle cover and comprising a first end and a second end each extending beyond a periphery of the middle cover, wherein each the first end and the second end of each of the first strap, the second strap, and the third strap comprise a hook and loop patch releasably attached to a hook and loop patch of the lower garment, wherein the front cover, the middle cover, and the rear cover are removable from the lower garment independent of each other.

10. An apparel comprising:

a lower garment designed to cover legs of a patient and comprising a front side, a rear side, a waist band comprising a front portion comprising a hook and loop patch and a rear portion comprising a hook and loop patch, and a crotch opening running from the front portion of the waist band to the rear portion of the waist band;

a front cover comprising a hook and loop patch releasably attached to the hook and loop patch of the front portion of the waist band;

a rear cover comprising a hook and loop patch releasably attached to the hook and loop patch of the rear portion of the waist band;

a middle cover releasably attached to the lower garment in between the front cover and the rear cover; and a strap connected to one of the front cover, the rear cover, and the middle cover, the strap comprising a first end and a second end each extending beyond a periphery of the one of the front cover, the rear cover, and the middle cover, wherein the front cover, the middle cover, and the rear cover are removable from the lower garment independent of each other.

* * * * *